US008632211B2

(12) United States Patent
Cho

(10) Patent No.: US 8,632,211 B2
(45) Date of Patent: Jan. 21, 2014

(54) FLAT LED LIGHTING DEVICE

(75) Inventor: Hankyu Cho, Seoul (KR)

(73) Assignee: LG Electronics Inc., Seoul (KR)

( * ) Notice: Subject to any disclaimer, the term of this patent is extended or adjusted under 35 U.S.C. 154(b) by 126 days.

(21) Appl. No.: 13/274,673

(22) Filed: Oct. 17, 2011

(65) Prior Publication Data

US 2012/0182733 A1 Jul. 19, 2012

(30) Foreign Application Priority Data

Jan. 13, 2011 (KR) ..... 10-2011-0003493

(51) Int. Cl.
*F21V 5/00* (2006.01)

(52) U.S. Cl.
USPC ..... 362/235; 362/97.3; 362/249.02; 362/613

(58) Field of Classification Search
USPC ..... 362/612, 613, 97.1, 97.3, 800
See application file for complete search history.

(56) References Cited

FOREIGN PATENT DOCUMENTS

| | | |
|---|---|---|
| DE | 20 2009 004 706 U1 | 9/2010 |
| JP | 2001-083893 | 3/2001 |
| JP | 2003-187605 | 7/2003 |
| KR | 10-0215127 | 8/1999 |
| KR | 10-0649641 | 11/2006 |
| KR | 20-2008-0000342 | 3/2008 |
| KR | 10-2008-0095222 | 10/2008 |
| KR | 10-0883345 | 2/2009 |
| WO | WO 2006/098799 | 9/2006 |

OTHER PUBLICATIONS

European Search Report dated Oct. 1, 2012 for Application 11186608.3.

*Primary Examiner* — Anabel Ton
(74) *Attorney, Agent, or Firm* — KED & Associates LLP

(57) ABSTRACT

A flat LED lighting device may include a flat LED light source having a plurality of light emitting diodes (LED) devices, a diffuser for scattering a light from the LED devices, a glare preventive member for preventing as a side glare, and an intermediate layer provided between the diffuser and the glare preventive member. The intermediary layer may have a different refractive index than the diffuser. The glare preventive member may include a transparent plate and a plurality of micro-lenses on the transparent plate for changing a distribution of the light.

15 Claims, 5 Drawing Sheets

(a)

(b)

| reflectance of | | | | | | | | | | | |
|---|---|---|---|---|---|---|---|---|---|---|---|
| Ceiling | | 0.7 | 0.7 | 0.5 | 0.5 | 0.3 | 0.7 | 0.7 | 0.5 | 0.5 | 0.3 |
| Wall | | 0.5 | 0.3 | 0.5 | 0.3 | 0.3 | 0.5 | 0.3 | 0.5 | 0.3 | 0.3 |
| Floor Cavity | | 0.2 | 0.2 | 0.2 | 0.2 | 0.2 | 0.2 | 0.2 | 0.2 | 0.2 | 0.2 |
| Room dimension | | View endwise (C0) | | | | | View crosswise (C90) | | | | |
| x | y | | | | | | | | | | |
| 2H | 2H | 14.7 | 16.1 | 15.1 | 16.4 | 16.7 | 14.6 | 16.1 | 15.0 | 16.4 | 16.7 |
| | 3H | 15.4 | 16.6 | 15.7 | 17.0 | 17.3 | 15.4 | 16.6 | 15.7 | 17.0 | 17.3 |
| | 4H | 15.6 | 16.8 | 16.0 | 17.2 | 17.5 | 15.7 | 16.9 | 16.1 | 17.2 | 17.6 |
| | 6H | 15.9 | 17.0 | 16.3 | 17.3 | 17.7 | 16.0 | 17.1 | 16.4 | 17.5 | 17.8 |
| | 8H | 15.9 | 17.0 | 16.3 | 17.4 | 17.8 | 16.1 | 17.1 | 16.5 | 17.5 | 17.9 |
| | 12H | 16.0 | 17.0 | 16.4 | 17.3 | 17.8 | 16.1 | 17.1 | 16.5 | 17.5 | 17.9 |
| 4H | 2H | 15.0 | 16.2 | 15.4 | 16.5 | 16.9 | 14.9 | 16.1 | 15.3 | 16.5 | 16.8 |
| | 3H | 15.9 | 16.9 | 16.3 | 17.2 | 17.7 | 15.8 | 16.8 | 16.2 | 17.2 | 17.6 |
| | 4H | 16.3 | 17.2 | 16.8 | 17.6 | 18.1 | 16.3 | 17.1 | 16.7 | 17.6 | 18.0 |
| | 6H | 16.6 | 17.4 | 17.1 | 17.9 | 18.3 | 16.6 | 17.4 | 17.1 | 17.8 | 18.3 |
| | 8H | 16.8 | 17.5 | 17.2 | 17.9 | 18.1 | 16.8 | 17.5 | 17.2 | 17.9 | 18.4 |
| | 12H | 16.9 | 17.5 | 17.3 | 18.0 | 18.5 | 16.9 | 17.5 | 17.3 | 18.0 | 18.5 |
| 8H | 4H | 16.4 | 17.2 | 16.9 | 17.6 | 18.1 | 16.4 | 17.1 | 16.9 | 17.6 | 18.0 |
| | 6H | 16.9 | 17.5 | 17.4 | 18.0 | 18.5 | 16.8 | 17.4 | 17.3 | 17.9 | 18.4 |
| | 8H | 17.1 | 17.6 | 17.7 | 18.2 | 18.6 | 17.1 | 17.6 | 17.6 | 18.1 | 18.6 |
| | 12H | 17.3 | 17.7 | 17.8 | 18.2 | 18.7 | 17.2 | 17.7 | 17.8 | 18.2 | 18.7 |
| 8H | 4H | 16.5 | 17.1 | 16.9 | 17.6 | 18.1 | 16.4 | 17.1 | 16.9 | 17.5 | 18.0 |
| | 6H | 17.0 | 17.5 | 17.5 | 18.0 | 18.5 | 16.9 | 17.4 | 17.4 | 17.9 | 18.4 |
| | 8H | 17.2 | 17.6 | 17.7 | 18.1 | 18.6 | 17.1 | 17.6 | 17.7 | 18.1 | 18.6 |

FLAT LED LIGHTING DEVICE

CROSS-REFERENCE TO RELATED APPLICATION

This application claims priority under 35 U.S.C. §119 from Korean Application No. 10-2011-0003493 filed Jan. 13, 2011, the subject matter of which is incorporated herein by reference.

BACKGROUND

1. Field

An embodiment may relate to a flat light emitting diode (LED) lighting device. More particularly, an embodiment may relate to a flat LED lighting device that can prevent (or reduce) side glare.

2. Background

An incandescent lamp, a halogen lamp, a discharge lamp, and/or so on may be used as a lighting device. The lighting device may also include a Light Emitting Diode (LED). The LED lighting device may use an LED device as a light source. The LED device may emit a light as minority carriers recombine, after producing the minority carriers injected to a semiconductor by using a P-N junction. The LED device may emit light with a wavelength that varies based on the type of impurities, thereby providing a red color, a blue color, and/or a yellow color, and possibly producing a white color. The LED lighting device may have a size smaller than other light sources, such as the incandescent lamp, the halogen lamp, and/or so on. The LED lighting device may have advantages of a long lifetime, a good efficiency, and/or a fast response.

BRIEF DESCRIPTION OF THE DRAWINGS

Arrangements and embodiments may be described in detail with reference to the following drawings in which like reference numerals refer to like elements and wherein.

DETAILED DESCRIPTION

Reference may now be made in detail to specific embodiments, examples of which may be illustrated in the accompanying drawings. Wherever possible, same reference numbers may be used throughout the drawings to refer to the same or like parts.

If a LED lighting device is used for a simple lighting, a direction of light may change by using a non-transparent diffusion cap. If a directional projection of the light is required for a particular purpose, a lens unit may be provided to the LED lighting device for guiding the light from the LED device.

The LED lighting device that requires a direction of the light may be provided with the lens unit or a combination of the lens unit and a reflective member. That is, the light from the lighting device may be made to have a direction by using the lens unit and the reflective member, so as to direct the light to a desired region.

The LED lighting device that requires no direction may use a diffuser for scattering the light. A flat LED lighting device is one example of the LED lighting device that requires no direction. The flat LED lighting device may have a flat LED light source with a plurality of LED devices and a diffuser provided over the flat LED lighting device for scattering the light by using the diffuser. The diffuser may have a light emission mode of the plurality of LED devices as the LED light source appears, not to be in a spot light form (i.e., a hot spot form) as they are, but rather in a surface light source form. However, since the flat LED lighting device has a Unified Glare Rating (UGR) that relates to a degree of glare, the CIE may be defined greater than 21, which may be in a range that is difficult for the user to receive, and/or may feel inconvenient even when the user receive. One method for relating to such a problem is to use of a louver, which is used in a fluorescent lamp. However, the louver may cause a structure of the flat LED lighting device to be great and complicated.

A flat LED lighting device may be described with reference to FIG. 1.

Figure 1:
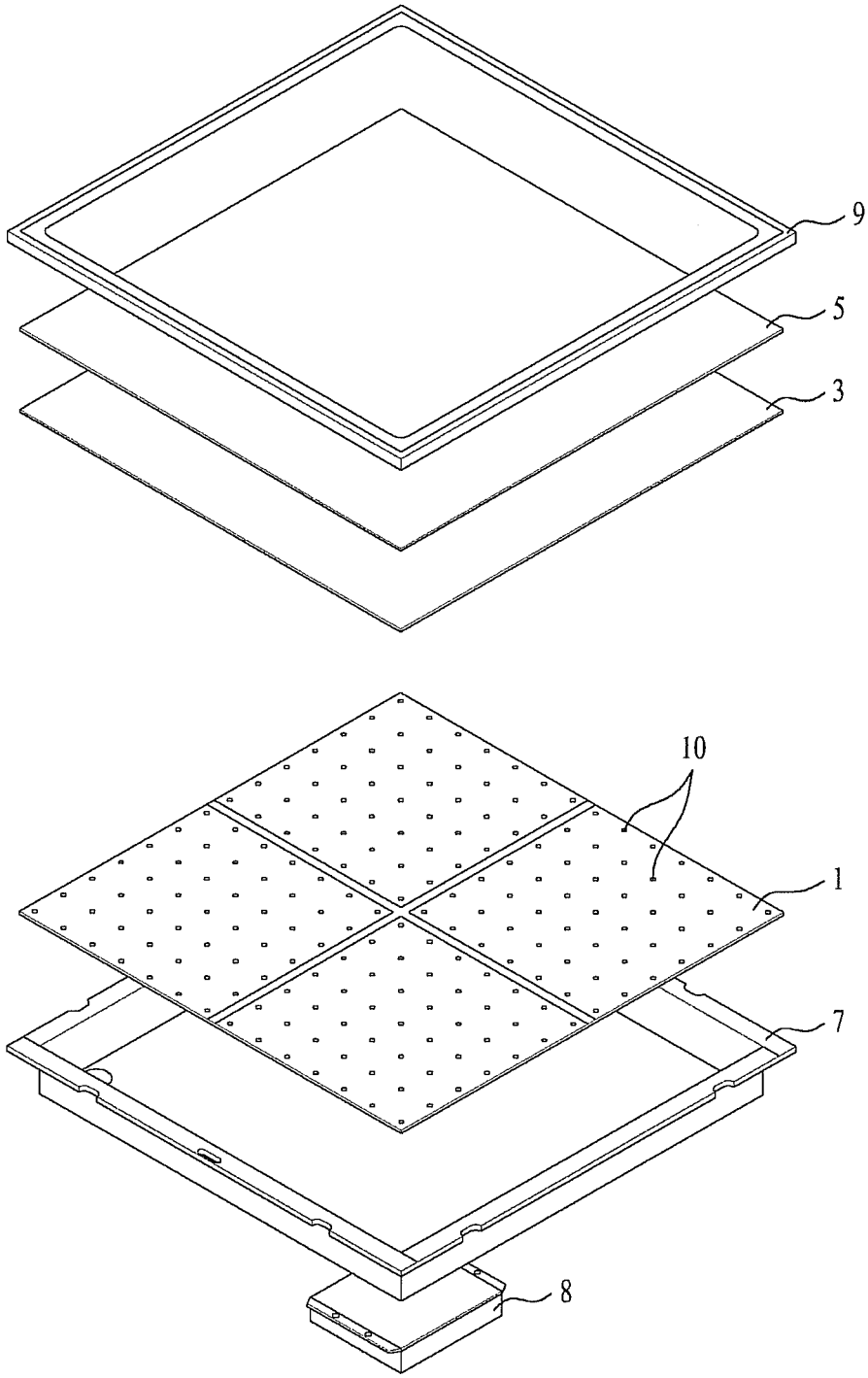
FIG. 1 illustrates an exploded perspective view of a flat LED lighting device in accordance with an embodiment.

FIG. 1 shows an LED light source 1 mounted to a housing in a lower cover 7. The LED light source 1 may have a plurality of LED devices 10. A diffuser 3 may be provided over the LED light source 1 to scatter the light from the LED devices 10. A glare preventive member 5 (or glare preventive portion) may be provided over the diffuser 3. The glare preventive member 5 may prevent (or reduce) a side glare that a user sees when viewed from a side of the diffuser 3, as light from the diffuser 3 is particularly forwarded to a side of the diffuser 3. An upper cover 9 may be provided over the glare preventive member 5. A converter 8 may be provided to the lower cover 7 for converting a current to the LED light source 1.

The lower cover 7 may have step portions at edges for mounting (or providing) the diffuser 3 and the glare preventive member 5 thereto. The diffuser 3 may also be provided to the step portions at the edges of the lower cover 7, and the glare preventive member 5 may be mounted to step portions formed additionally at edges of the upper cover 9.

The flat LED lighting device may include the LED light source 1, the diffuser 3, and the glare preventive member 5 formed flat such that the flat LED lighting device may serve as a surface light source.

As one embodiment, the flat LED lighting device may be mounted on a ceiling and/or a wall. The LED light source may be provided inward from a plane that defines the ceiling or the wall. This type of lighting device may only allow light to be provided directly underneath.

Figure 2:
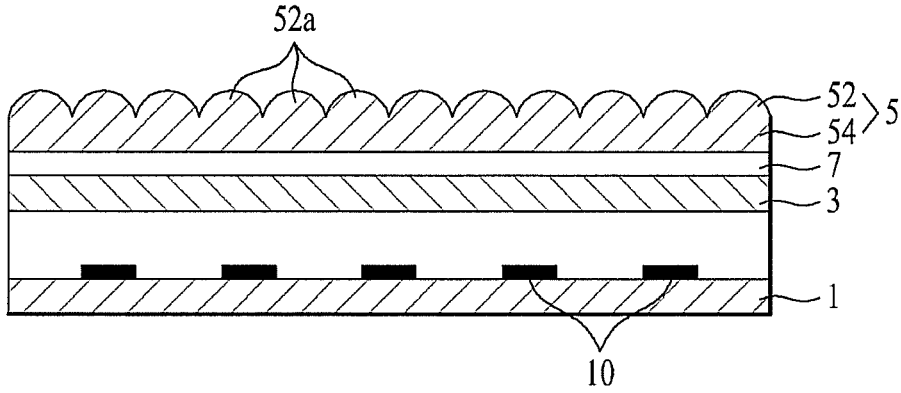
FIG. 2 illustrates a longitudinal section of FIG. 1.

The diffuser 3 and the glare preventive member 5 may be described with respect to FIG. 2.

As described above, the diffuser 3 may be provided over the flat LED light source 1 having the plurality of LED devices 10. The diffuser 3 may scatter the light from the LED light source 1. The glare preventive member 5 may be provided over the diffuser 3. The glare preventive member 5 may be provided so to be in contact with the diffuser 3 or may be spaced apart from the diffuser 3.

The diffuser 3 may be formed of a mixture of a diffusing agent to have no unevenness. That is, the light from the LED light source 1 may be scattered by the diffusing agent mixed in the diffuser 3, so as to remove hot spots. The diffuser 3 may be formed of polycarbonate. The glare preventive member 5 may include a transparent plate 54 and a micro-lens array 52 having a plurality of micro-lenses 52*a* that change a light distribution for preventing glare from taking place. Although the micro-lens 52*a* has very small size that is not visible with naked eyes, FIG. 2 illustrates an exaggerated micro-lens 52*a*.

The glare preventive member 5 includes the transparent plate 54 for transmission of the light, and the micro-lens array 52 coupled to the transparent plate 54 by a UV resin.

If the transparent plate 54 and the diffuser 3 have a same refractive index such as the transparent plate 54 and the diffuser 3 being formed of an identical material (e.g. polycarbonate), an intermediate layer may be provided between the transparent plate 54 and the diffuser 3. The intermediate layer may have a refractive index different from the transparent plate 54 and the diffuser 3. If the intermediate layer exists, the light from the diffuser 3 may be effectively guided to the micro-lens array 52.

The transparent plate 54 may be spaced a predetermined distance from the diffuser 3 so as to form a gap 7 between the diffuser 3 and the transparent plate 54. The gap 7 may be an air gap. An air gap is one example of the intermediate layer. The air gap 7 may be provided between the diffuser 3 and the transparent plate 54. Since air has a refractive index of 1, and the polycarbonate has a refractive index of 1.586, the intermediate layer may be present between the transparent plate 54 and the diffuser 3. In order to provide the air gap 7, the transparent plate 54 may not need to be spaced apart from the diffuser 3. In an example that the transparent plate 54 is in contact with the diffuser 3, the air gap 7 may substantially exist between the transparent plate 54 and the diffuser 3. If the transparent plate 54 is not coupled to the diffuser 3, but is just in contact with the diffuser 3, the air gap 7 may be substantially provided between the transparent plate 54 and the diffuser 3.

Figure 3:
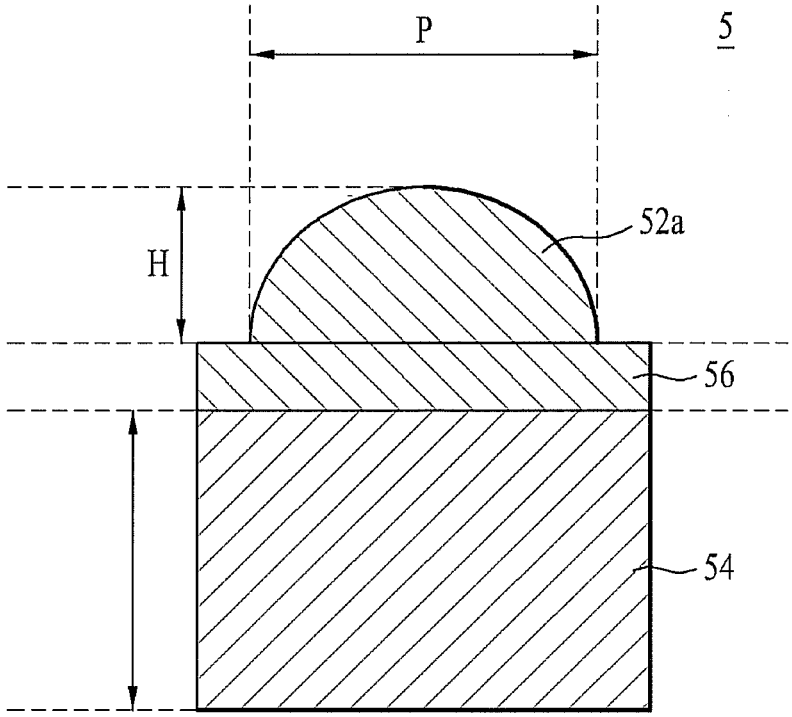
FIG. 3 illustrates an enlarged sectional view of a portion of a glare preventive portion in FIG. 2.

The glare preventive member 5 may be described with reference to FIG. 3.

The micro-lens 52*a* may have a semispherical shape. The micro-lens 52*a* may have a pitch of 20~100 μm, and more preferably may have a pitch of approximately 58 μm. In this example, since the micro-lens 52*a* is a semispherical, the micro-lens 52*a* may have a height of approximately 29 μm. One desirable reason for defining the shape and the size of the micro-lens 52*a* may be provided. As a result of research, it is known that the greater the pitch P of the micro-lens 52*a*, the better the micro-lens 52*a* may become in view of a total light quantity. However, it is known that the smaller the pitch P of the micro-lens 52*a*, the better the micro-lens 52*a* may become in view of side glare prevention. Therefore, in order to prevent the side glare from taking place while not substantially reducing a total light flux, the micro-lens 52*a* may have a pitch of 20~100 μm. FIG. 3 also shows a UV setting agent 56, and the transparent plate 54.

A principle of side glare prevention may be described with reference to FIG. 4.

Figure 4:
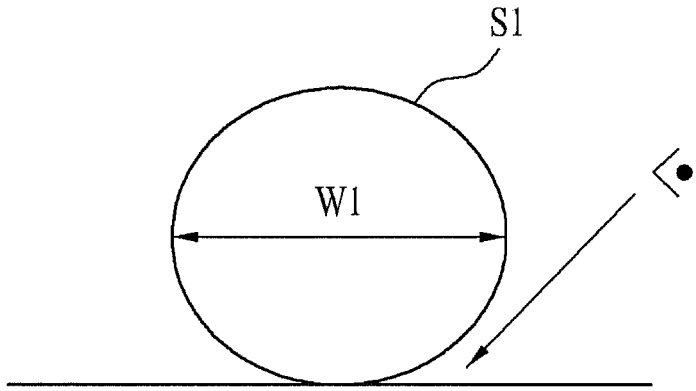
FIG. 4A illustrates a schematic view of a light distribution.
FIG. 4B illustrates a schematic view of the light distribution of FIG. 1.
Figure 4:
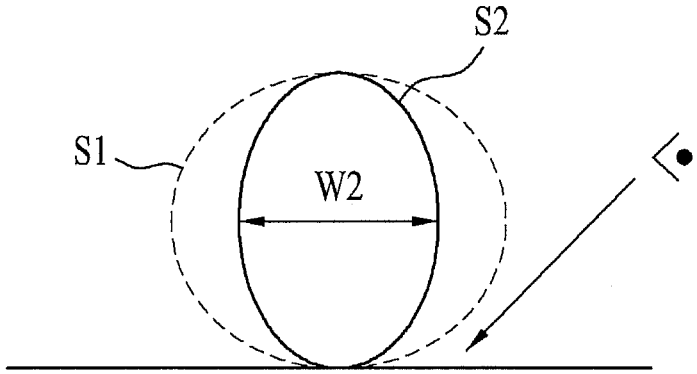

FIG. 4(*a*) illustrates a schematic view of a light distribution. FIG. 4(*b*) illustrates a schematic view of the light distribution of FIG. 1. As can be known from FIG. 4(*a*), since the light distribution has a relatively great width W1, forwarding the light in a lateral direction may cause intensive side glare. However, as can be seen from FIG. 4(*b*), since the light distribution has a relatively small width W2, making the user unable to see the light when the user looks from a side of the diffuser 3, side glare may be reduced.

Figures 5, 6:
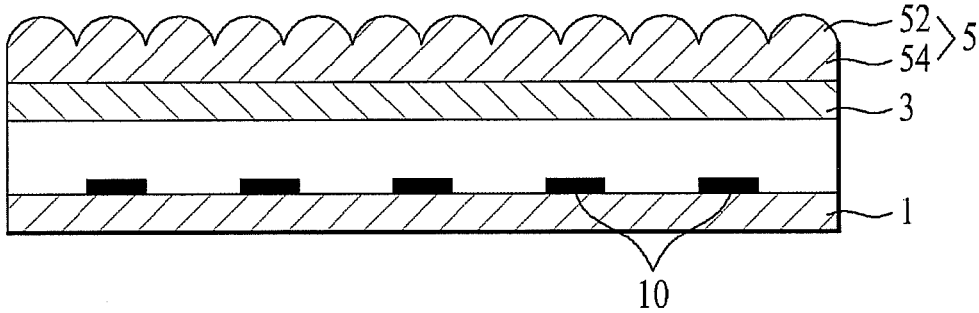
FIG. 5 illustrates a table of experimental data of a UGR in FIG. 2.
FIG. 6 illustrates a section of a flat LED lighting device in accordance with an embodiment.

FIG. 5 illustrates measurements of glare of the micro-lens 52*a* having a shape and a size as illustrated in FIG. 4. As can be seen from FIG. 5, an embodiment may make the UGR to be below 19 throughout the entire flat LED lighting device.

A flat LED lighting device in accordance with an embodiment may be described with reference to FIG. 6. Other embodiments and configurations may also be provided.

This FIG. 6 embodiment has a principle similar to the previously described embodiment, except that this embodiment enables contact of the transparent plate 54 (of the glare preventive member 5) to the diffuser 3, without providing a gap therebetween. In this embodiment, the transparent plate 54 of the glare preventive member 5 may be coupled to the diffuser 3. The refractive index of the transparent plate 54 may be different from the refractive index of the diffuser 3. For example, while the transparent plate 54 is coupled to the diffuser 3, the transparent plate 54 of the glare preventive member 5 may have a refractive index greater than the refractive index of the diffuser 3. That is, even though the transparent plate 54 is made to be in contact with the diffuser 3, a material of the transparent plate 54 may have a refractive index greater than the refractive index of the diffuser 3. This configuration may more effectively guide the light transmitted through the diffuser 3 to the glare preventive member 5, without spreading the light to the edges.

A flat LED lighting device in accordance with an embodiment may be described with reference to FIG. 7. Other embodiments and configurations may also be provided.

Figure 7:
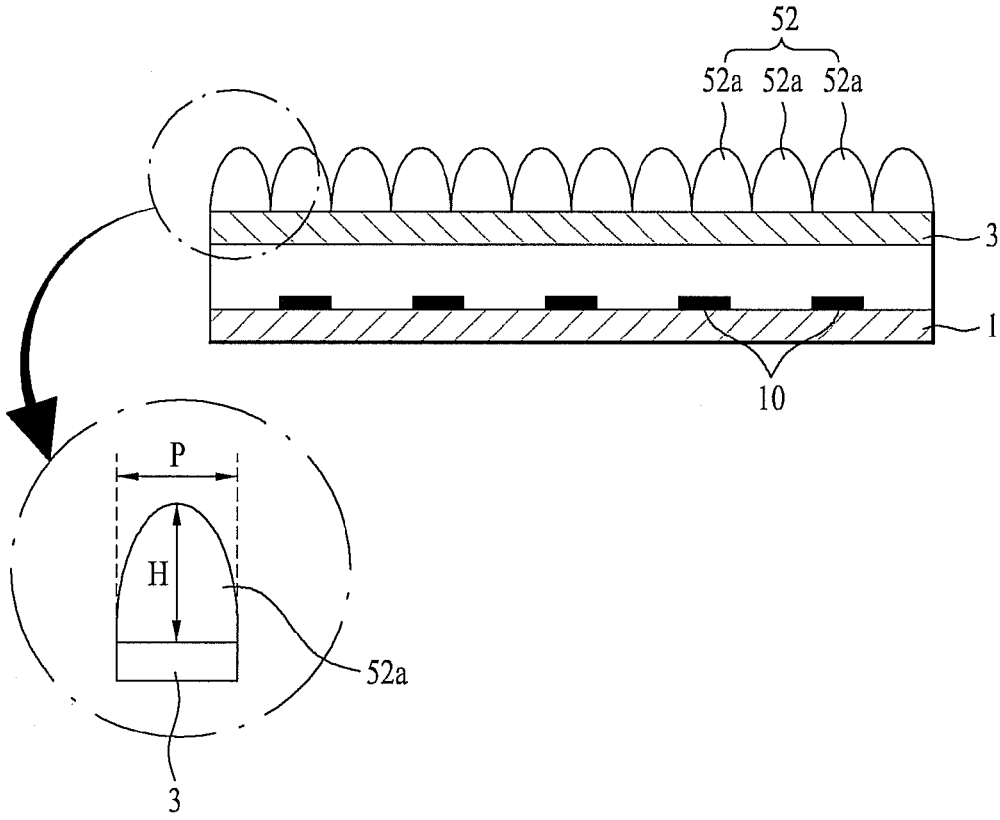
FIG. 7 illustrates a section of a flat LED lighting device in accordance with an embodiment.

This FIG. 7 embodiment may include direct coupling of the micro-lens array 52 (of the glare preventive member 5) to the diffuser 3 without using the transparent plate 54. The micro-lens 52*a* may be formed to have a height H greater than a pitch P. The micro-lens array 52 may be coupled to the diffuser 3 with a UV resin.

A flat LED lighting device in accordance with an embodiment may be described with reference to FIG. 8. Other embodiments and configurations may also be provided.

Figure 8:
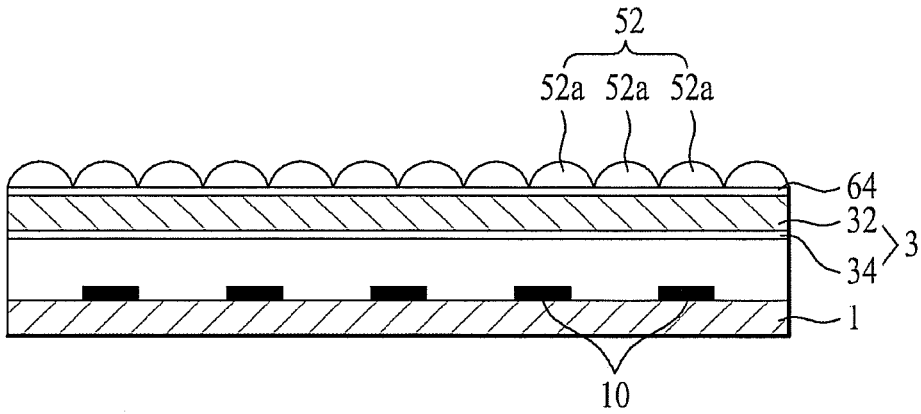
FIG. 8 illustrates a section of a flat LED lighting device in accordance with an embodiment.

Like the FIG. 7 embodiment, the FIG. 8 embodiment may also include direct coupling of the micro-lens array 52 (of the glare preventive member 5) to the diffuser 3. However, different from the FIG. 7 embodiment, the FIG. 8 embodiment may include coupling of the semi-spherical micro-lens 52*a* with a UV resin 64 of a high refractive index.

Although a non-transparent diffuser 3 may be used by mixing a diffusing agent, the diffusing agent 34 may be coupled to a bottom of a transparent mother member 32 by an appropriate method.

The flat LED lighting device and the method for fabricating the same as described above may have advantages.

A reduction of UGR, which denotes a rate of glare, to be below 19 may enable the consumer to receive the glare and to reduce the glare difficult to perceive.

Fabrication of the flat LED lighting device may become simple while reducing the glare.

Embodiments may provide a flat LED lighting device and a method for fabricating the same that reduces glare.

Embodiments may provide a flat LED lighting device of which fabrication is simple while reducing glare.

A flat LED lighting device may include a flat LED light source having a plurality of LED devices, a diffuser for scattering a light from the LED devices, and a glare preventive member (or portion) for preventing (or reducing) a side glare from taking place, the glare preventive member having a micro-lens array with a plurality of micro-lenses for changing a distribution of the light.

The glare preventive member may include a transparent plate for transmitting the light, and the micro-lens array coupled to the transparent plate. The transparent plate may have a refractive index that is the same with a refractive index of the diffuser, and another refractive index may be present between the transparent plate and the diffuser. The transparent plate may be spaced a predetermined distance away from the diffuser, and an air gap may exist between the transparent plate and the diffuser.

The micro-lens may be semi-spherical. The micro-lens may have a pitch of 20~100 μm, and more preferably the micro-lens may have a pitch of approximately 58 μm.

The transparent plate may be in contact with the diffuser, and the transparent plate may have a refractive index greater than the refractive index of the diffuser. The micro-lens may be provided to the diffuser, and may have a height greater than the pitch thereof. The micro-lens may be coupled to the diffuser with a UV resin of a high refractive index. The micro-lens may be semi-spherical.

A method for fabricating a flat LED lighting device may be provided that includes scattering a light from an LED light source by using a diffuser, and changing a distribution of the light from the diffuser by using a micro-lens array, which is a set of micro-lenses for reducing the light forwarded to a side.

The micro-lens may have a semi-spherical shape coupled to a transparent plate having a refractive index that is the same with a refractive index of the diffuser, with an air gap present between the transparent plate and the diffuser.

The micro-lens may have a semi-spherical shape coupled to a transparent plate having a refractive index that is greater than a refractive index of the diffuser. The transparent plate may be in contact with the diffuser without the air gap. The micro-lens may have a height greater than a pitch thereof, and the micro-lens may be coupled to the diffuser. The micro-lens may have a semi-spherical shape coupled to the diffuser with a UV resin of a high refractive index.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A flat light emitting diode (LED) lighting device comprising:

a plurality of LED devices;

a diffuser to scatter a light from the plurality of LED devices, the diffuser including a diffusing agent, wherein the diffuser is spaced apart from the plurality of LED devices;

a glare preventive member for preventing a side glare, the glare preventive member including a transparent plate and a plurality of micro-lenses on the transparent plate for changing a distribution of the light; and an intermediate layer provided between the diffuser and the glare preventive member, wherein the intermediate layer is an air layer, wherein the transparent plate has a same refractive index as the diffuser, wherein the transparent plate has a refractive index different from the intermediate layer, wherein the transparent plate is spaced apart from the diffuser.

2. The lighting device of claim 1, wherein the diffuser has a same refractive index as the plurality of micro-lenses.

3. The lighting device of claim 1, wherein each of the plurality of micro-lenses are semi-spherical.

4. The lighting device of claim 1, wherein the micro-lens has a pitch of 20~100 μm.

5. The lighting device of claim 1, wherein the micro-lens has a pitch of approximately 58 μm.

6. The lighting device of claim 1, wherein the micro-lens has a height of approximately 29 μm.

7. A lighting device comprising:

a lower cover;

a flat light emitting diode (LED) light source provided in the lower cover, the LED light source having a plurality of LED devices;

a diffuser on the LED light source to scatter light from the LED light source, the diffuser including a diffusing agent, wherein the diffuser is spaced apart from the plurality of LED devices;

a glare preventive member to reduce a side glare from the lighting device, the glare preventive member including a transparent plate and a microlens array on the transparent plate to change a distribution of the light;

an upper cover; and a converter provided to the lower cover for converting a current to the LED light source, wherein the transparent plate has a refractive index greater than the refractive index of the diffuser.

8. The lighting device of claim 7, wherein the microlens array includes a plurality of micro-lenses.

9. The lighting device of claim 8, wherein the diffuser has a same refractive index as the plurality of micro-lenses.

10. The lighting device of claim 8, wherein each of the plurality of micro-lenses are semi-spherical.

11. The lighting device of claim 8, wherein the micro-lens has a pitch of 20~100 μm.

12. The lighting device of claim 8, wherein the micro-lens has a pitch of 58 μm.

13. The lighting device of claim 7, wherein the diffuser and the microlens array are made of different materials.

14. The lighting device of claim 8, wherein the micro-lens has a height greater than a pitch thereof.

15. A lighting device comprising:

a plurality of LED devices;

a diffuser to scatter a light from the plurality of LED devices, the diffuser including a diffusing agent; and a glare preventive member for preventing a side glare, the glare preventive member including a transparent plate and a plurality of micro-lenses on the transparent plate for changing a distribution of the light, wherein the micro-lens is coupled to the diffuser with a UV resin of a high refractive index, and wherein the micro-lens has a pitch of 20~100 μm.

* * * * *